US005380987A

United States Patent [19]

Morici

[11] Patent Number: 5,380,987

[45] Date of Patent: Jan. 10, 1995

[54] ELECTRIC HEATER COLD PIN INSULATION

[75] Inventor: John A. Morici, Des Plaines, Ill.

[73] Assignee: UOP, Des Plaines, Ill.

[21] Appl. No.: 150,314

[22] Filed: Nov. 12, 1993

[51] Int. Cl.[6] ..... H05B 3/48

[52] U.S. Cl. ..... 219/544

[58] Field of Search ..... 219/523, 541, 544; 392/497; 338/273, 274, 238, 239, 240, 241, 242, 243

[56] References Cited

U.S. PATENT DOCUMENTS

| | | | |
|---|---|---|---|
| 1,735,168 | 11/1929 | King | 338/238 |
| 3,045,102 | 7/1962 | Fessenden | 219/541 |
| 3,195,093 | 7/1965 | Dillon | 338/273 |
| 3,197,728 | 7/1965 | Wright | 338/274 |
| 3,403,368 | 9/1968 | Scardina | 338/274 |
| 3,632,977 | 1/1972 | Takayasu | 219/523 |
| 4,129,774 | 12/1978 | Inano et al. | 219/544 |
| 4,178,497 | 12/1979 | Cunningham | 219/544 |
| 4,314,401 | 2/1982 | Saku | 338/242 |
| 5,066,852 | 11/1991 | Willbanks | 219/544 |

FOREIGN PATENT DOCUMENTS

| | | | |
|---|---|---|---|
| 2425054 | 12/1975 | Germany | 219/541 |

*Primary Examiner*—Geoffrey S. Evans

*Attorney, Agent, or Firm*—Thomas K. McBride; John G. Tolomei

[57] ABSTRACT

An improved resistance heater tube for use in heating process streams uses a moisture impermeable and heat resistant insulating material on the cold pin section to prevent shorting of the heater. In a heater tube hollow tubing to surrounds wire resistance elements and a non-conductive and heat resistant packing fills the tube to insulate the wire from the tube wall. Air permeates the packing to allow proper oxidation of the resistance wiring. Cold pins provide terminal ends for electrically connecting the wire ends to a power source. The cold pins extend into the Tube through the packed material and connect with the wire. The water impermeable coating covers cold pin at the tube end to prevent water absorption from grounding the cold pin to the tube wall and shorting out the heating element.

10 Claims, 1 Drawing Sheet

Fig. 1
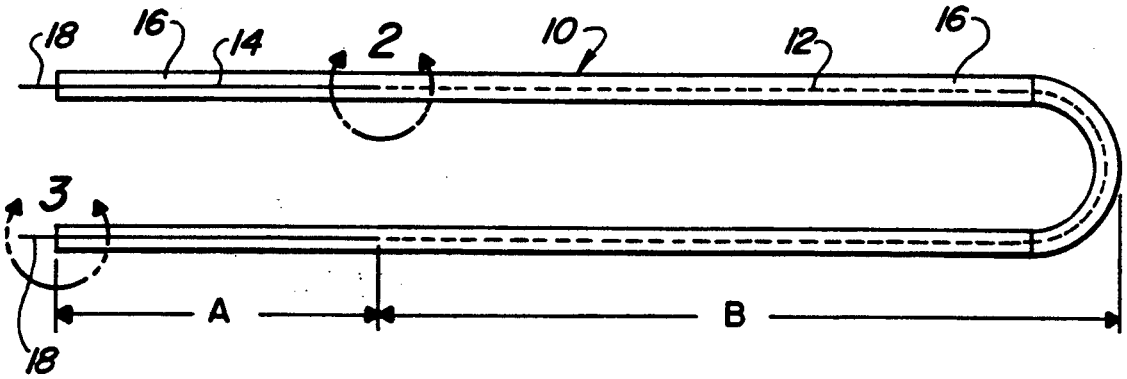
Fig. 2
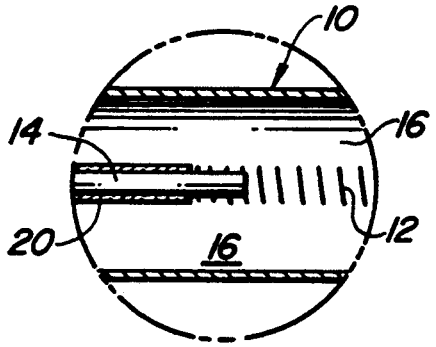
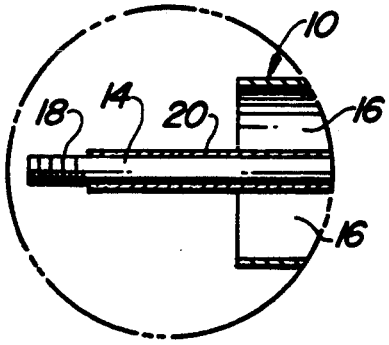
Fig. 3

ELECTRIC HEATER COLD PIN INSULATION

BACKGROUND OF THE INVENTION

1. Field of the Invention

This invention relates generally to the field of heaters for processing hydrocarbons and petrochemicals. More specifically this invention relates to electric resistance heaters for use in petrochemical and hydrocarbon conversion processes.

2. Description of the Prior Art

Most refining and petrochemical processes operate at elevated processing conditions. The feedstreams or intermediate streams entering these processes are often heated using electrical resistance heating. Electric resistance heating has advantages of safe and clean operations as well as compact and highly adaptable installations.

Electrical resistance heating uses a heater tube. The heater tube houses a heating element. These electric heaters usually employ a conductor in the form of a cold pin (sometimes referred to as terminal pin) which is used to electrically connect junction box terminal wiring to a wire resistance portion of an electric heater tube. The pin is termed "cold" because it does not generate heat like the resistance wire portion of the element. The cold pin extends the terminal into a portion of the heater tube across which the process stream flows and in which the portion of the resistance element passes.

In a typical tube construction the cold pin and resistance element are centered in a grounded metal tube and electrically insulated from that tube by a gas permeable insulating material. Heating elements of this type routinely use hollow tubing to provided the outer wall of the heating element to surround wire resistance elements. A non-electrically conductive packing surrounds a wire that is located in the tube. The packing fills the tube to center the wire and insulate the wire from the tube wall. Air permeates the packing to allow proper oxidation of the resistance wiring. A typical insulating material is magnesium oxide powder which has been compacted to a chalk like solid. Magnesium oxide, absorbs moisture at ambient conditions from the atmosphere. The electrical resistance of magnesium oxide drops proportionally with moisture content. The time period between manufacture of the heater tube and startup of the process equipment allows degradation of the electrical insulating capability of the magnesium oxide due to moisture ingress.

The cold pins extend into the tube through the packed material and connect with the wire. Moisture is absorbed at the terminal box end of the tube and penetrates into the element between the cold pin and the tube. Significant moisture penetration will not ordinarily proceed beyond the cold pin. The moisture ingress through an insulator such as a magnesium oxide element is believed to occur in a plug flow fashion. The cold pin area of the element is expected to saturate completely before the wire section of the element is reached. Therefore, the cold pin area is the most frequent location for ground faults due to moisture ingress. The cold pin is the most damaging area to have a short within the electrical element because there is minimal resistance between the power supply and the point of short.

Prior to initial electrical firing of the heater the insulation resistance is checked and low insulation values can prevent powering the heater. Applying design voltage to a heater with low resistance readings leads to electrical faults occurring through the wet insulation. Electrical faults cause permanent damage to elements. Faults can blow fuses, damage wiring, trip breakers, and cause damage to the process containing piping and flanges.

If detected before firing, the magnesium oxide, or other insulating powder, can be dried and insulation values restored by driving off moisture by subjecting it to high temperatures. The removal of moisture from the heater element insulation is an inconvenient and time consuming process.

Moreover, even where excess moisture in the packed insulation material is detected, problems develop when the moisture is not completely driven out before firing of the heater elements. In such cases a temperature gradient develops as the heater element section is powered. The gradient causes a concentration of moisture as vapor is driven to the point along the element where the dew point is reached. Moisture that concentrates in the cold pin area can produce a later detected ground fault.

Therefore, the presence of moisture interferes with the operation of heater tubes. Many tube manufactures seal heater tubes to prevent moisture ingress. Methods of sealing the heater tube or packing to prevent moisture ingress have not generally been successful. Moreover, even where the seal is successful, most wire heating elements must breath during operation or their life is reduced. It is important that the resistance element breathe in order to draw in oxygen. For example, in the case of nickel-chromium resistance wire the presence of oxygen at high temperature will form chromium oxide on its surface which will extend the life of the wire. Thus, achievement of maximum operational life mandates any seal be temporary and destroyed once the element is put into use. Once the seal is gone, any shutdowns can begin the moisture ingress again. Thus any prolonged down times for the heater can create the need to dry out the insulation again before firing.

BRIEF SUMMARY OF THE INVENTION

It is a general object of this invention to improve the reliability of electric resistance heaters.

It is a more specific object of this invention to provide an electric heater tube that does not require drying to avoid moisture related ground faults.

This invention is an improved resistance heating element for use in heating process streams that has a moisture impervious or water impermeable coating that covers an elongated connector, i.e. cold pin, at the tube end. The moisture impervious coating prevents water adsorption from grounding the cold pin to the tube wall and shorting out the heating element. The moisture impervious coating covers the length of the elongate connector, except at its ends where it is connected to a resistance wire or other heating element inside the tube and provides a terminal attachment point outside the heater tube. The coating is in addition to the insulating material in the form of packed powders currently provided in most heater tubes. The packed powder is still provided to allow the heating element to properly oxidize. In this manner the coating provides an added layer of electrical insulation in the cold pin region that will not lose insulating capability when the permeable packing material adsorbs moisture.

The coating has the advantage of making the heater element more tolerant to moisture penetration that does occur between the time of manufacture and startup. The coating prevents the moisture penetration that does occur from lowering insulation resistance to values that would produce a ground fault. The coating also allows rapid powering of the tubes even in the case of moisture presence. Any gradient that causes a concentration of moisture as the vapor is driven along the element to the point where the due point is reached will not pose severe problems. Moisture concentration in the cold pin area will not produce a ground short due to the presence of the coating. Shorts between the wire heating elements and the tube are less severe because current is limited by the resistance of the wire between the power supply and the point of the short. As a result, the coating will eliminate the need for heater dry out, reduces element faults due to moisture, and makes moisture detection and other protective equipment largely unnecessary.

Accordingly, in one embodiment this invention is a electric resistance heater tube. The tube encloses an electrical resistance wire and has an elongate conductor that extends from one end of the tube that extends with the opposite end of the conductor end connected to an end of the heating wire within the tube. A heat resistant and water impermeable insulating material covers a portion of the elongate conductor at or near the end of the heater tube. A gas permeable insulating material is packed between the tube and the electric resistance wire and the tube and the elongate conductor to prevent short circuiting of the conductor or wire with the tube.

Other objects, embodiments, and details of this invention are described in the following detailed description of the invention.

BRIEF DESCRIPTION OF THE DRAWINGS

FIG. 1 is a cross-section of a typical heater tube of this invention.

FIG. 2 is an enlarged detail of the heater tube cross-section at the junction of the conductor and wire element.

FIG. 3 is an enlarged view of the heater tube cross-section showing the end of the heater tube and a conductor.

DETAILED DESCRIPTION OF THE INVENTION

The heater tube of this invention has broad application to a wide variety of refining and petrochemical processes. Specifically the heater tube will find application in electric resistance heaters for such processes as reforming, dehydrogenation, isomerization, oxygenate recovery, gas separation, desulfurization, hydrotreating, and hydrocracking. Furthermore, this invention will have application in any process that uses electrical emersion heaters.

FIG. 1 shows a typical arrangement for a beater tube. In its most basic form, the beater tube consists of a tubing 10 surrounding an electric resistance element in the form of a heating wire 12 and a portion of an elongate conductor 14 generally referred to as a cold pin. Gas permeable packing 16 separates the wire 12 and conductor 14 from the heater tube wall. A terminal end 18 extends outwardly from the tube 10 to provide a point for electrical connection of the heater tube to a power source. Heater tube 10 is divided into two sections: A and B. Section A, often referred to as the cold pin section, houses a portion of the elongate conductor 14. Section B depicts a wire element section where heater tube 10 surrounds the electric resistance wire 12.

In conventional applications, the outer surface of tube 10 directly contacts the medium receiving heat input from the heating tube. Tube 10 can be made from any material that will withstand the environment imposed by the composition and conditions of the medium undergoing heating and that will have sufficient structural strength to withstand forces imposed on the outside and inside of the tube. In most cases the heater tube material will also have high thermal conductivity. Appropriate materials are well known to those skilled in the art of heater tube design. The most typical tube wall constructions consist of a single layer of metallic material such as carbon steel or high or low allow steels. The tube may also have any shape that will suite a particular heater application. Most commonly the tube walls have a "U" shape.

Tube 10 completely contains electric resistance wire 12. As shown by FIG. 2, tube 10 contains the ends of wire 12 at the connection point of cold pin 14 to wire 12.

Wire 12 may consist of any material and be in any shape that will provide the desired electric resistance heating. Compositions and shapes for electric resistance heating elements are well known to those skilled in the art. The electric resistance heating element may be of any material and in any form that will provide the desired electrical heating. Heating elements such as wire elements, commonly known to those skilled in the art, will provide the electric resistance heating element in most cases. A particularly preferred form for the electric resistance heating element is a spiral wound nickel chromium wire.

Cold pin 14 electrically connects the terminal wire to a power source located outside of the heater tube. In addition to the pin depicted in FIG. 1, the invention can use any form of elongate conductor that will traverse the tube wall boundary to connect the wire heating element with a power source. Materials for the elongate conductor will usually comprise steel, copper or aluminum. In addition, the pin or elongate conductor need not extend out of the end of the heater tube. For example the conductor can alternately consist of a flat strip of material that extends through the sidewall and an insulator that prevents contact between the tube wall and the conductor. In such a construction the end of the tube may still be left open to communicate the gas permeable insulating material with the atmosphere or additional openings in the tube wall may provide communication of the insulating material across the tube wall.

The gas permeable insulating material centers wire 12 and pin 14 within the heater tube and generally prevents shorting of the wire element with the heater tube wall. The preferred nickel chromium wire composition and most other materials for the electric resistance heating element require an oxygen-containing atmosphere. Communication of the interior of the heater tube with an oxygen containing atmosphere prolongs the life of the wire 12.

Therefore, the gas permeable insulating material is usually in the form of a powder. In a typical construction, compaction of the powder gives it a chalklike consistency that serves to center the cold pin 14 and wire 12. Any non-corrosive, high dielectric, heat conductive and thermally stable material that will permit gas permeation when packed can serve as a suitable material between the wire 12, cold pin 14, and tube wall 10. Possible materials for the gas permeable insulation include crushed fireclay, magnesium silicate, and ground mica. A particularly preferred gas permeable insulating material is magnesium oxide.

Even when packing material 16 is relatively non-hygroscopic significant moisture penetration can still occur when the heater tubes are exposed to a high humidity environment. Moisture penetration through many of the packing materials, and in particular magnesium oxide, is generally believed to occur, in a plug flow fashion. Thus the cold pin area, section A of the heater tube, will in normal circumstances saturate completely before the wire section B of the heater tube experiences any significant moisture increase. As a result, the cold pin portion of the heater tube is ordinarily exposed to the gas permeable insulating material having the highest moisture content.

A heat resistant and water impermeable insulating material, shown as coating 20 in FIG. 2, surrounds the outside of cold pin 14 to prevent shorting of cold pin 14 with tube wall 10 when gas permeable insulating material 16 has a high moisture content. Coating 20 can consist of any heat resistant and water impermeable insulating material such as baked enamel, ceramic, porcelain, glass and high temperature polymers. Preferred coating materials are baked enamel or ceramic. The coating material should also be relatively thin to provide room for loading the packing material into the tube and filling the annulus between the cold pin and tube wall with packing material. Preferably the coating material will have a thickness of from 2 to 200 mils.

Coating material 20 will preferably extend into the tube by a distance equal to the maximum distance that moisture is expected to ingress through the tube or to the point of attachment between pin 14 and wire 12. In preferred form the coating will extend over the entire length A of pin 14 up to the connection between the pin 14 and wire 12 and, at the opposite end up to terminal connection point.

FIG. 3 shows a preferred form for the opposite end of pin 14. In preferred form, coating 20 also covers a portion of pin 14 that extends past the end of tube 10. Preferably coating 20 will cover the entire extended portion of pin 14 except for a terminal portion 18 where electrical contact is made between pin 14 and a power source. In typical form, terminal connection 18 will be at the end of pin 14 and comprise a threaded section to accept a bolted terminal connection.

I claim:

1. An electric resistance heater tube comprising:
a) an electric resistance heating element;
b) a metallic tube enclosing said heating element, said tube having a tube wall;
c) an elongate conductor connected to an end of said heating element and extending out of said tube wall;
d) a heat resistant and water impermeable insulating material covering a portion of said elongate conductor located within an end of said tube; and,
e) a gas permeable insulating material packed between said tube and said electric resistance heating element and between said tube and said portion of said elongate conductor located within an end of said tube.

2. The heating element of claim 1 wherein said electric resistance heating element comprises a spiral wound nickel-chromium wire.

3. The heating element of claim 1 wherein said elongate conductor comprises a pin that extends out of an end of said tube.

4. The heating element of claim 1 wherein said heat resistant and water impermeable insulating material comprises a baked enamel or a porcelain coating.

5. The heating element of claim 1 wherein said heat resistant and water impermeable insulating material comprises a coating and said coating extends along said elongate conductor from the connection of said electric resistance heating element to the outside of said tube.

6. The heating element of claim 1 wherein said gas permeable insulating material comprises compressed magnesium oxide powder.

7. The heating element of claim 1 wherein said heat resistant and water impermeable material has a thickness of from 2 to 200 mils.

8. An electric heater tube comprising:
a) an electric resistance wire having a nickel-chromium composition and a spiral wound configuration;
b) a tube enclosing said wire and having a U-shape;
c) an elongate pin at each end of said tube partially disposed within said tube having one end connected to one end of said wire and an opposite end extending out of said tube;
d) a heat resistant and water impermeable insulating material covering a portion of said elongate pin located within said pin and a portion of said elongate pin extending outside of said tube proximate the end of said tube; and,
e) a gas permeable insulating material packed between said tube and said electric resistance wire and between said tube and said the portion of said elongate pin having the covering of heat resistant and water impermeable insulating material.

9. The heater tube of claim 8 wherein said heat resistant and water impermeable insulating material comprises a coating and said coating extends along said elongate conductor from the connection of said wire outside of said tube.

10. The heater tube of claim 8 wherein said gas permeable insulating material comprises compressed magnesium oxide powder.

* * * * *

UNITED STATES PATENT AND TRADEMARK OFFICE

CERTIFICATE OF CORRECTION

PATENT NO. : 5,380,987

DATED : January 10, 1995

INVENTOR(S) : John A. Morici

It is certified that error appears in the above-identified patent and that said Letters Patent is hereby corrected as shown below:

In Column 3, line 57: Change "beater" to --heater--;

line 58: Change "beater" to --heater--.

Signed and Sealed this

Twenty-third Day of May, 1995

Bruce Lehman

*Attest:*

BRUCE LEHMAN

*Attesting Officer*

*Commissioner of Patents and Trademarks*